United States Patent [19]

Froumajou

[11] 3,971,349

[45] July 27, 1976

[54] FUEL FEED OF ROTARY CYLINDER COMBUSTION ENGINES

[75] Inventor: Armand Froumajou, Pontoise, France

[73] Assignees: Automobiles Peugeot, Paris; Regie Nationale des Usines Renault, Boulogne-Billancourt, both of France

[22] Filed: Nov. 29, 1974

[21] Appl. No.: 528,572

[30] Foreign Application Priority Data

Dec. 27, 1973 France ..... 73.46593

[52] U.S. Cl. ..... 123/44 D; 123/75 B

[51] Int. Cl.[2] ..... F02B 57/04

[58] Field of Search ..... 123/44 R, 44 D, 44 E, 123/75 B; 92/58

[56] References Cited

UNITED STATES PATENTS

| | | | |
|---|---|---|---|
| 1,292,295 | 1/1919 | Freer | 123/44 D |
| 2,317,625 | 4/1943 | Mallory | 123/75 B |
| 3,556,060 | 1/1971 | Blabaud | 123/75 B |

FOREIGN PATENTS OR APPLICATIONS

| | | | |
|---|---|---|---|
| 1,372,166 | 8/1964 | France | 123/44 E |

*Primary Examiner*—C. J. Husar
*Assistant Examiner*—Leonard Smith
*Attorney, Agent, or Firm*—Burns, Doane, Swecker & Mathis

[57] ABSTRACT

The invention is applied to a combustion engine having a stator and a rotor which defines, with the stator inner wall, radial rotating cylinders in which reciprocating pistons are adapted to reciprocate in such manner that the induction ports and exhaust ports in the stator inner wall communicate with each cylinder respectively during the induction and exhaust stages of a four-stroke cycle. The feature of the invention is the provision of two series of induction ports disposed in parallel. The fuel feed device of the engine has respective fuel feed means associated with each of the two series of induction ports.

2 Claims, 5 Drawing Figures

FUEL FEED OF ROTARY CYLINDER COMBUSTION ENGINES

Figure 2:
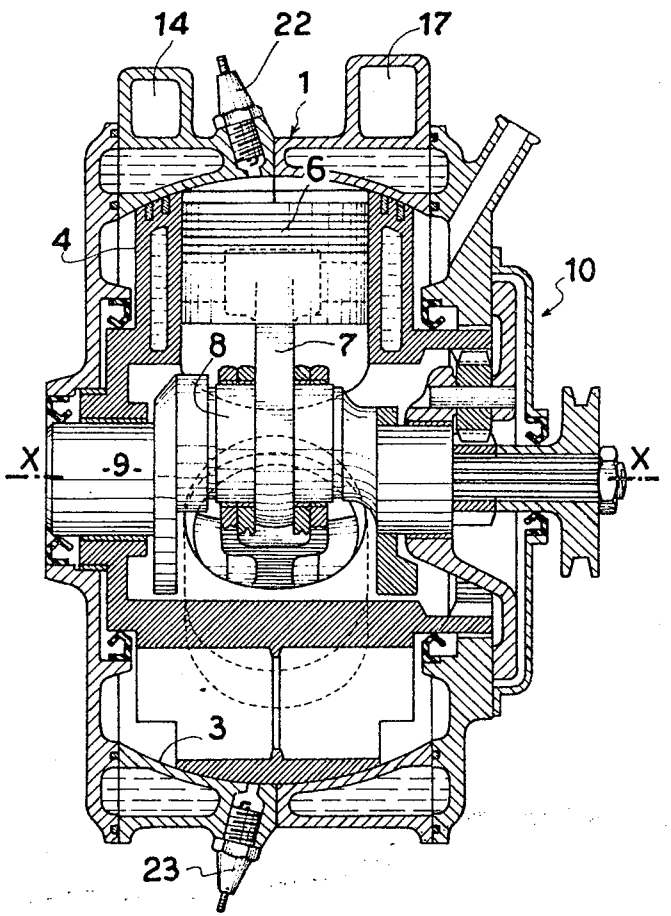

The present invention relates to combustion engines having a rotary cylinder block.

More precisely it relates to a combustion engine of the type comprising a stator in which are formed the induction and exhaust ports, a rotor received in the stator and defining cylinders in which are movable pistons, a combustion chamber being defined, in each cylinder, between the piston and the inner wall of the stator, means being provided to relate the rotational movement of the rotor to the alternating movements of the pistons in such manner that the induction and exhaust ports are in communication with each cylinder respectively in the induction and exhaust stages of the four-stroke cycle.

Many versions have been proposed of engines of the aforementioned type.

It is moreover known that in four-stroke combustion engines, it is desirable to modify, in accordance with the conditions of operation of the engine, the value of the fraction of the cycle during which the fuel feed occurs. Indeed, the longer the relative duration of the feed period the better is the filling at high speed owing to dynamic gas flow phenomena. On the other hand, operation at idling and low speeds is then liable to be disturbed. In known engines having valves, the devices employed for modifying in accordance with the conditions of operation of the engine the fraction of the cycle during which fuel feed occurs are very complicated, costly and unreliable. This is why none of these devices has been adopted in mass-production.

It is also known to employ carburetors of the compound or duplex type which permit adapting to a certain extent the feed characteristics to the conditions of operation. These carburetors have two bodies of different dimensions each of which bodies is provided with a throttle, the throttle openings being ensured in succession, the throttle of the smaller body opening first under the action of the accelerator pedal.

An object of the present invention is to arrange the fuel feed device of a rotary cylinder, valveless, four-stroke engine in such manner as to modify in accordance with the conditions of operation of the engine the value of the fraction of the cycle during which the feed occurs, this being achieved by particularly simple means.

There is provided in accordance with the invention an engine of the type defined hereinbefore wherein there are provided two series of induction ports disposed in parallel and the fuel feed device comprises respective fuel feed means associated with each of the series of ports.

According to another feature of the invention, the fuel feed device comprising in the known manner a duplex carburetor having two bodies the opening of which bodies is ensured successively, each series of induction ports is connected to one of the carburetor bodies, the circumferential lengths of the ports connected to the body the opening of which occurs first being less than those of the ports connected to the other body of the carburetor.

According to another feature of the invention, the smaller body of the duplex carburetor is connected to the corresponding induction ports through a pipe whose cross section is less than that of the pipe connected to the larger body of the carburetor.

Figure 1:
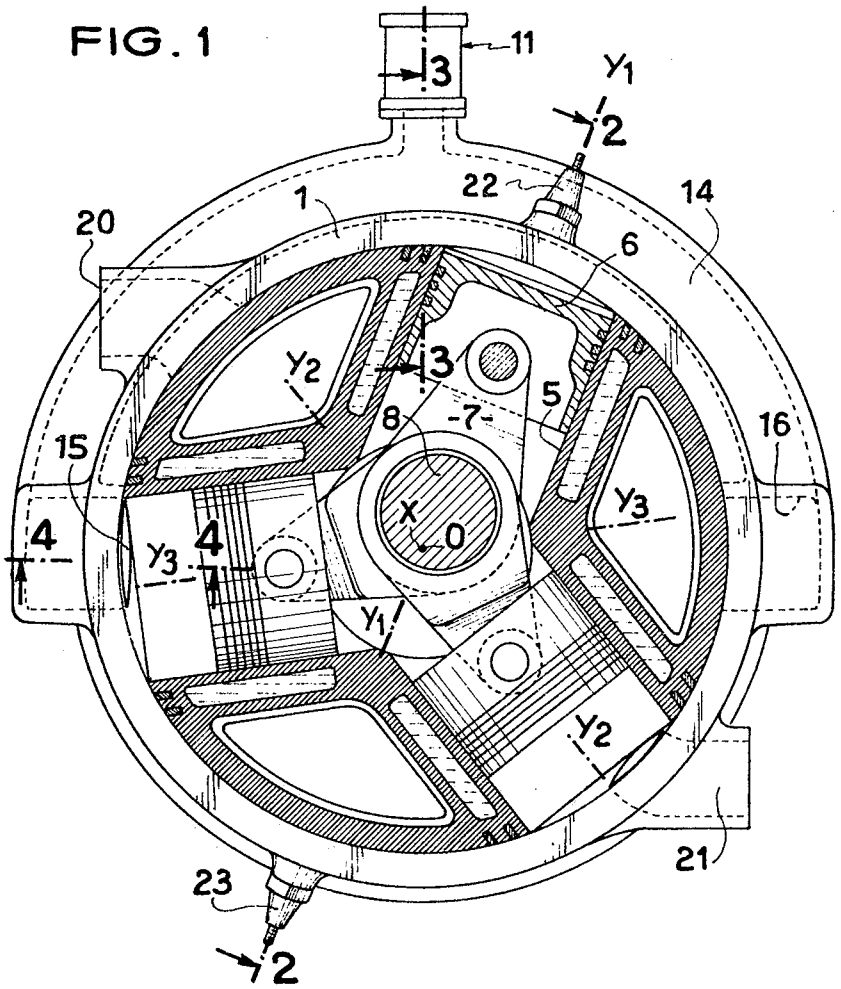
Figure 4:
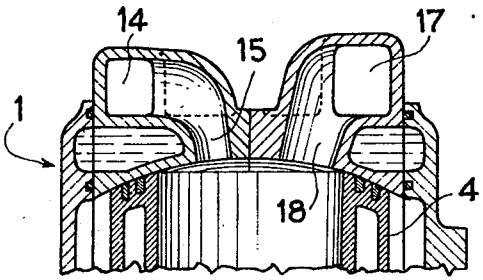
Figure 3:
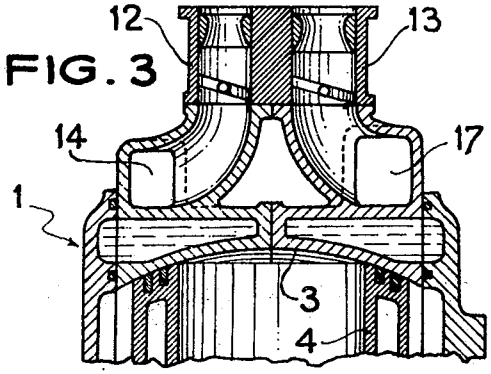
Figure 5:
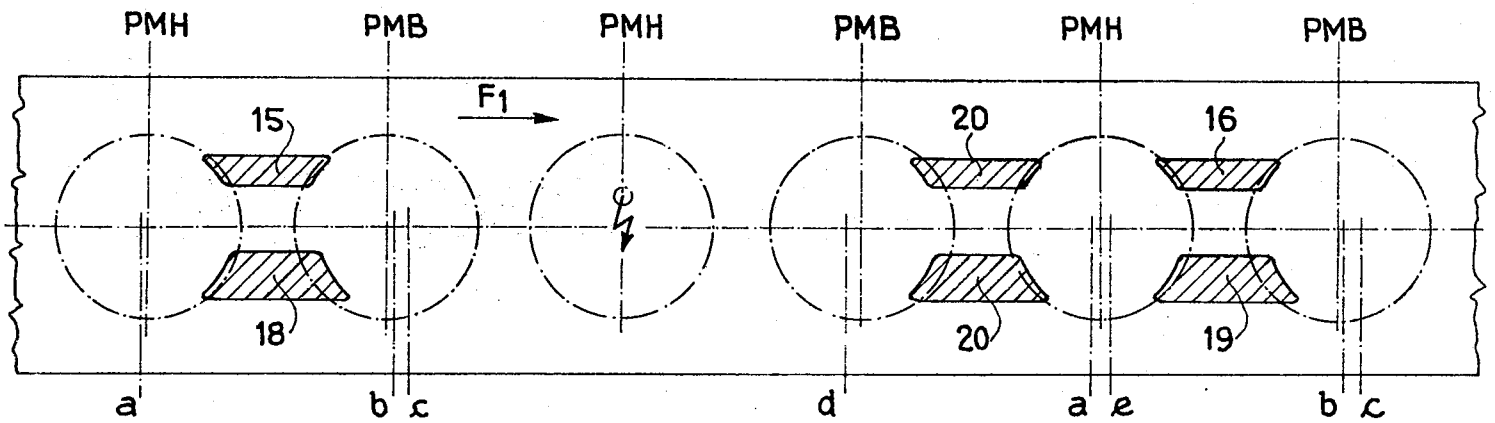

An embodiment of the invention will now be described in more detail in the ensuing description with reference to the accompanying drawings in which:

FIG. 1 is a cross-sectional view of an engine according to the invention;

FIGS. 2, 3 and 4 are sectional views taken on lines 2—2, 3—3 and 4—4 of FIG. 1, and FIG. 5 is a developed diagrammatic view of the engine.

The engine shown by way of example comprises a stator 1 which encloses an inner volume defined partly by a spherically-shaped surface 3 having a centre 0.

In this inner volume is mounted a rotor 4 which is rotatable about an axis X—X passing through the centre 0. This rotor has three radiating cylinders 5 whose axes $Y_1$—$Y_1$, $Y_2$—$Y_2$, $Y_3$—$Y_3$ are contained in the same transverse plane, there being disposed a piston 6 in each cylinder 5. Each piston 6 is connected by a connecting rod 7 to the crank 8 of a crankshaft 9 whose axis corresponds to axis X—X.

Transmission means, constituted by a planet gear train 10, operatively interconnects the rotor 4 and crankshaft 9 so that the passage of the cylinders in front of a given point on the stator occurs for the same position of their piston, corresponding to the same stage of the operational cycle. Such means are known per se and therefore need not be described in detail in the present description.

The feeding of a mixture of air and fuel to the engine is ensured by a carburetor 11 of the compound or duplex type having a small carburetor body 12 and a large carburetor body 13. The small body 12 communicates with a first pipe 14 having a generally semi-circular shape which communicates by way of ports 15 and 16 with the internal volume of the stator 1. The large body 13 communicates with a second pipe 17 also of a generally semi-circular shape which communicates by way of ports 18 and 19 with the internal volume of the stator 1. As can be seen in FIGS. 2, 3 and 4, the cross-section of the pipe 14 connected to the small body 12 of the carburetor is smaller than that of the pipe 17 connected to the large body 13.

Further, the engine has exhaust ports 20, 21 and ignition sparking plugs 22, 23.

FIG. 5 shows how the induction ports corresponding to the same cycle of the engine, namely 15 and 18, on one hand, and 16 and 19, on the other, are disposed along the periphery of the stator. It can be seen that the circumferential length or extent of the ports 15 and 16 is less than that of the ports 18 and 19 so that, in its movement of rotation, each cylinder 5 remains in communication with the second pipe 17 during a longer period than with the first pipe 14. Moreover, the width of the ports 15 and 16 is less than that of the ports 18 and 19.

In FIG. 5 there have been shown the various characteristic positions of a cylinder which moves with respect to the stator in the direction of arrow $F_1$ and the positions of the exhaust ports and sparking plugs. The positions of the piston for each characteristic position of the cylinder have also been shown.

Also shown in FIG. 5 are the positions of the axes of the cylinders at the start and at the end of their communication with the induction and exhaust ports.

a. Start of the communication with both the induction ports 15 and 18 (or 16 and 19).

b. End of the communication with the induction port 15 (or 16).

c. End of the communication with the induction port 18 (or 19).

d. Start of the communication with the exhaust ports 20 (or 21).

e. End of the communication with the exhaust ports 20 (or 21).

Thus it can be seen that there is a modification of the value of the fraction of the cycle during which the fuel feed to the cylinders of the engine occurs, since, when only the small body 12 of the carburetor is operative, the feed occurs between the positions *a* and *b* whereas, when the large body 13 is in operation, the feed occurs between the positions *a* and *c*.

It is clear that it is unnecessary to have a coincidence between the starts of the communication of a cylinder with the two ports 15 and 18 (or 16 and 19) and, if necessary, a staggering may be provided as for the ends of the communication.

Further, owing to the total separation of the two feed circuits respectively connected to one and the other of the bodies of the carburetor, there is provided a pipe of small section when only the small body is in service. This permits obtaining an improved carburation. Indeed, with the usual arrangements in which the same pipe is employed irrespective of the flow of the gaseous mixture, the flow at idling speed, per unit section of the pipe, is necessarily low which is disadvantageous in the obtainment of a good homogenization.

It will be noted that if the main or larger body 13 of the carburetor comprises its own idling speed circuit, it is of interest to arrange that the latter open out under the throttle of the small body so that the required result is achieved for operation at the idling speed of the engine.

Having now described my invention what I claim as new and desire to secure by Letters Patent is:

1. In a combustion engine comprising a stator having an inner wall, a series of induction ports and exhaust ports in the stator inner wall, a fuel feed device communicating with the induction ports, a rotor received in the stator and defining cylinders with the stator inner wall, pistons movable in the cylinders, means for reciprocating the pistons in the cylinders upon rotation of the rotor relative to the stator, a combustion chamber being defined, in each cylinder, between the piston and the inner wall of the stator, means for ensuring that the rotation of the rotor and the reciprocating movements of the pistons are related in such manner that the induction and exhaust ports communicate with each cylinder respectively during the induction and exhaust stages of a four-stroke cycle; the improvement comprising an additional series of induction ports disposed in the stator inner wall in parallel with the first-mentioned series of induction ports so that each induction port of the first-mentioned series communicates with each cylinder in parallel with the corresponding induction port of the additional series, and an additional fuel feed device communicating with the induction ports of the additional series of induction ports, the respective induction ports of each one of the two series having different circumferential extents.

2. In a combustion engine comprising a stator having an inner wall, a series of induction ports and exhaust ports in the stator inner wall, a fuel feed device communicating with the induction ports, a rotor received in the stator and defining cylinders with the stator inner wall, pistons movable in the cylinders, means for reciprocating the pistons in the cylinders upon rotation of the rotor relative to the stator, a combustion chamber being defined, in each cylinder, between the piston and the inner wall of the stator, means for ensuring that the rotation of the rotor and the reciprocating movements of the pistons are related in such manner that the induction and exhaust ports communicate with each cylinder respectively during the induction and exhaust stages of a four-stroke cycle; the improvement comprising an additional series of induction ports disposed in the stator inner wall in parallel with the first-mentioned series of induction ports so that each induction port of the first-mentioned series communicates with each cylinder in parallel with the corresponding induction port of the additional series, and an additional fuel feed device communicating with the induction ports of the additional series of induction ports, the fuel feed devices being combined in a duplex carbureter having a first carbureter body and a second carbureter body, the opening of which bodies is ensured in succession, the first body being connected to said first-mentioned series of induction ports and the second body being connected to said additional series of induction ports, the respective induction ports of each one of the two series having different circumferential extents, the carbureter body which is intended to open first being connected to the induction ports having the smallest circumferential extent.

* * * * *